US005259682A

United States Patent [19]

Uchiyama

[11] Patent Number: 5,259,682

[45] Date of Patent: Nov. 9, 1993

[54] APPLICATOR FOR VOLATILE, HIGHLY VISCOUS FLUIDS

[76] Inventor: Yasuo Uchiyama, 6-14, Koami-Cho, Nihon-Bashi, Chuo-Ku, Tokyo, Japan

[21] Appl. No.: 866,972

[22] Filed: Apr. 10, 1992

[30] Foreign Application Priority Data

Apr. 12, 1991 [JP] Japan ..... 3-32747[U]
Sep. 10, 1991 [JP] Japan ..... 3-080778[U]

[51] Int. Cl.[5] ..... B43K 9/00; B05C 1/02; A45D 34/04

[52] U.S. Cl. ..... 401/185; 401/186; 401/202; 401/269; 401/271; 401/278; 401/288

[58] Field of Search ..... 401/162-167, 401/183-186, 202, 213, 247-269, 271, 278, 288

[56] References Cited

U.S. PATENT DOCUMENTS 1,044,996 11/1912 Cuthbertson ..... 401/269 X
1,725,464 8/1929 Lysons ..... 401/288
4,748,990 6/1988 Brown et al. ..... 401/288 X
4,859,104 8/1989 Roeder et al. ..... 401/202
4,958,748 9/1990 Otake ..... 401/183 X

FOREIGN PATENT DOCUMENTS 2509978 9/1976 Fed. Rep. of Germany ..... 401/202
9115136 10/1991 World Int. Prop. O. ..... 401/202

*Primary Examiner*—Danton D. DeMille
*Attorney, Agent, or Firm*—Brooks Haidt Haffner & Delahunty

[57] ABSTRACT

An applicator for volatile, highly viscous fluids has the following features:

Protruding into the mouth of a pressure-sensitive, expandable tank containing a fluid solution, there is a narrow diameter brush point pipe, and, around the outer circumference of the brush point pipe, thrusting out beyond its end, there is a tubular brush point. This is the main body. Set atop the main body is a cap which covers the brush point. The interior of this cap is provided with a solvent receptacle. When the cap is closed over the main body, there are provided within the cap a vapor space which is filled with vaporized solvent from the solvent receptacle, and a columnar plug which dovetails within the brush point pipe after passing through the hollow part of the brush point, which is inserted into the vapor space.

2 Claims, 6 Drawing Sheets

APPLICATOR FOR VOLATILE, HIGHLY VISCOUS FLUIDS

BACKGROUND OF THE INVENTION

1. Field of the Invention

This device pertains to applicators for volatile, highly viscous fluids such as nail polish, correction fluid for writing/typing purposes, paint, etc.

2. Description of Related Art

With present applicators for nail polish, the nail polish is placed inside a bottle; a polish applier brush of one piece with the bottle lid descends vertically into the fluid inside the bottle; and, during use, one opens the lid and withdraws the applier brush, which one uses to paint the fingernails.

Furthermore, there are also applicators in the style of writing implements, in which the nail polish goes out to the brush point by means of knock style pumping.

However, as for those applicators that have fluid inside a bottle, whenever the lid is opened, the nitrocellulose in the nail polish comes into contact with the air and volatilizes, and the nail polish thickens; before the nail polish inside the bottle is completely used up, it hardens, and a great deal of nail polish is left unused.

Furthermore, as for the aforementioned writing implement-style applicators, although by the container's opening being made small, the area coming into contact with the air is also diminished; still, the brush point is always in contact with the air, and thus the nail polish remaining on the brush point solidifies and the brush point stiffens and can no longer be used. For this reason, such writing implement-style applicators lower the viscosity of the nail polish. However, if the viscosity is decreased, the original color intensity of the nail polish cannot be maintained.

This device is one which has been created in view of these points: it provides for a volatile, highly viscous fluid applicator which can be used to the end without solidification of the volatile, highly viscous fluids placed inside the container, and, moreover, without stiffening of the brush point thus solving the above problems.

SUMMARY OF THE INVENTION

Thus, the present invention provides a device which has a pressure-sensitive expandable tank into which a fluid solution has been placed; a narrow diameter brush point pipe with one end protruding into the mouth of this tank; and a tubular brush point around the exterior of this brush point pipe, with the tip at its one end extending outward. The main body is formed of these structures.

Furthermore, covering the aforementioned brush point, and set onto the main body, there is a separate cap with the following interior construction. Inside this cap there are, respectively, a solvent receptacle and a vapor space filled with vaporized solvent from the appropriate solvent receptacle. Further, a columnar plug protrudes into this vapor space, and, when the cap is closed on the aforementioned main body, the brush point enters the vapor space and, moreover, this columnar plug dovetails into one end of the brush point pipe which passes through the hollow space of the brush point.

The volatile, highly viscous fluid is placed in the tank beforehand. The cap is removed from the main body and pressure is applied to the tank by hand, causing the highly viscous fluid to pass from the tank's mouth through the brush point pipe and thus to reach the inner area of the brush point.

Accordingly, at the moment when one holds the tank section to apply the highly viscous fluid, it flows thusly, hitting the brush point at this moment. In this manner, the highly viscous fluid is applied. Also, when the cap is closed over the main body, the brush point goes into the vapor space inside the cap, and the cap's columnar plug passes through the brush point's hollow center, and fits into the appropriate end of the brush point pipe. Because of this, the tank's mouth is closed and the highly viscous fluid is sealed into the tank. Further, the brush point sits within the vapor space, which is always filled with vaporized solvent, and, due to this solvent, the volatile, highly viscous fluid still adhering to the brush point does not harden.

The invention will be more fully understood from the following detailed description, especially when the same is read in view of the accompanying drawings.

DETAILED DESCRIPTION OF PREFERRED EMBODIMENTS

The present invention provides an applicator for which the volatile, highly viscous fluid placed within the container can be used to the end without hardening, and, moreover, for which the brush point will not become stiff.

Figure 1:
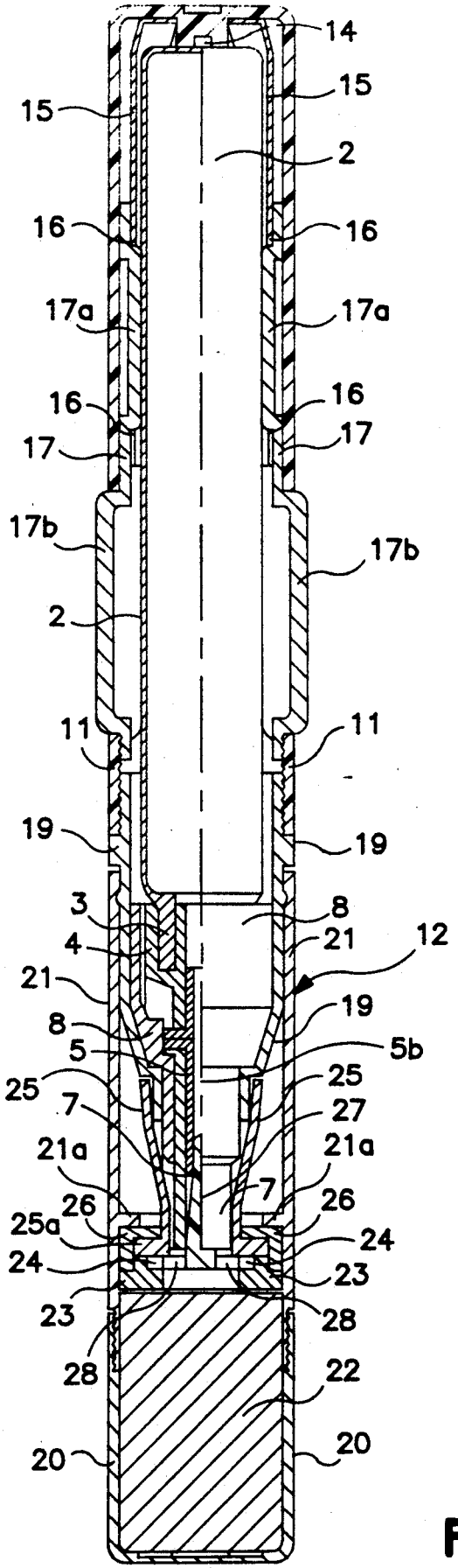
FIG. 1 is a cross-sectional view of the applicator of the invention.

Referring to FIG. 1 of the drawing it will be noted that the applicator is provided with a tank 2, which is made of pressure-sensitive expandable material and into which the volatile, highly viscous fluid has been placed. It is also provided with a narrow diameter brush point pipe 5 which extends into the mouth 3 of the tank 2, with and a brush point 7 which encircles the exterior of this brush point pipe 5, and thrusts out beyond the appropriate end of the brush point pipe 5. It is provided with a main body 1, which is comprised of these foregoing constructions. It is provided with a separate cap 12 placed atop the main body 1 to cover the above brush point 7, and provided with a solvent receptacle within this cap 12. Moreover, within the cap 12 are respectively provided, when the cap 12 is closed over the above main body 1, a vapor space filled with solvent vaporized from the above solvent receptacle, and into which the above brush point 7 is inserted, as well as a columnar stopper 27 which passes through the hollow interior of the above brush point 7 and dovetails within the brush point pipe 5.

Figure 2:
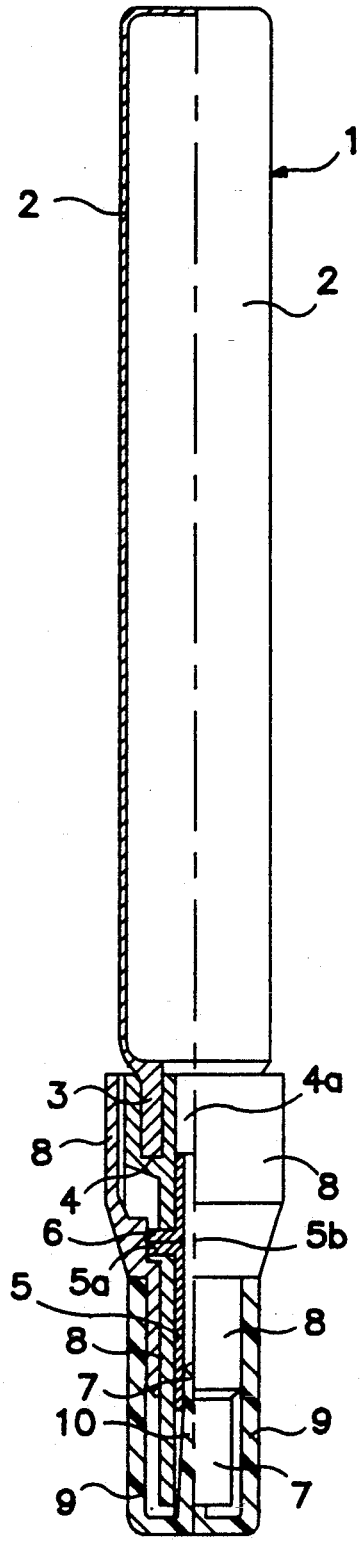
FIG. 2 is a view in partial cross-section of a main body of the applicator.

The construction of the main body 1 of the applicator is shown in FIG. 2.

The tank cap 4 covers and is affixed to the mouth 3 of the expandable tank 2, which is made of soft transparent synthetic resin and is sensitive to pressure from the hand. This tank cap 4 has a tap 4*a*. Into the end portion of the tank cap's 4 tap 4*a* is inserted one end of the narrow diameter brush point pipe 5, which has a guard brim 5*a* at the midsection of its exterior circumference. A ring of packing material 6 encircles the outer circumference of the brush point pipe 5 in the space between this guard rim 5*a* and tank cap 4. Also encircling the exterior circumference of the brush point pipe 5, running from the guard brim 5*a* toward the tip, a tubular brush point 7 is provided, and the tip of this brush point 7 protrudes outward, extending beyond the brush point pipe 5. The tank cap 4, ring of packing material 6, and one end of the brush point 7 are all placed inside the originally hollow interior of a brush point cover 8; the tip end of the brush point 7 protrudes out of the end of this brush point cover 8; and this brush point cover 8 is connected to the exterior circumference of the above tank cap 4.

Until the main body is inserted into the container body (to be described below), a protective cap 9 covers it. This protective cap 9 has a columnar stopper 10 inside it, and is so constructed that when it is affixed over the brush point cover 8, which covers the brush point 7, the columnar stopper 10 within the protective cap 9 passes through the hollow interior of the brush point 7 and fits into the hollow core 5*b* of the brush point pipe 5 in dovetail fashion.

The container body 11, which accomodates the above main body 1, and the cap 12 are constructed as follows.

Figure 3:
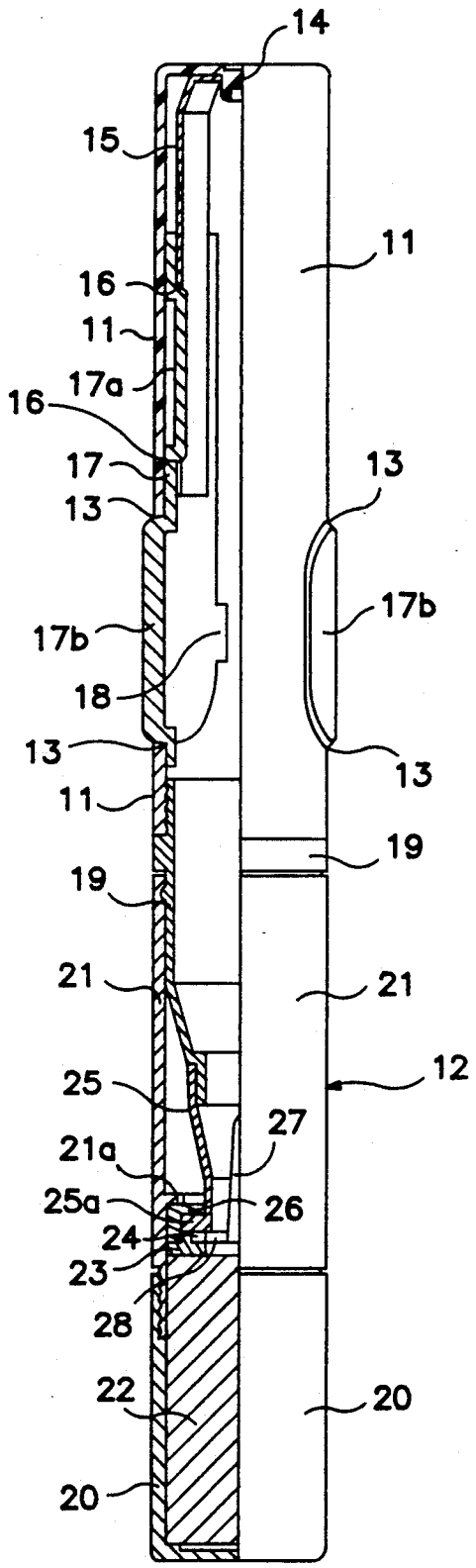
FIG. 3 is a view, partly in cross-section and partly in front elevation of a container body and cap according to the invention.

As shown in FIG. 3, the container body 11 is a tubular body with one end closed off, and with windows 13 cut into its outer circumference on both sides at about its middle. Furthermore, provided within the container body 11 are: a friction fitting snap support 14 on the inner side of the closed end of the container body 11; a "U"-shaped platform spring 15 with its base supported by this friction fitting snap support 14; and push buttons 17 which are supported by their projections at one end 17*a* being inset into the respective apertures 16 at the wings of either side of the platform spring 15. For each of these push buttons 17, the transparent, pressure-sensitive projections 17*b* at their respective opposite ends are thrust out through the respective windows 13 in the container body 11 to its exterior, due to the tensile strength of the platform spring 15.

Figure 4:
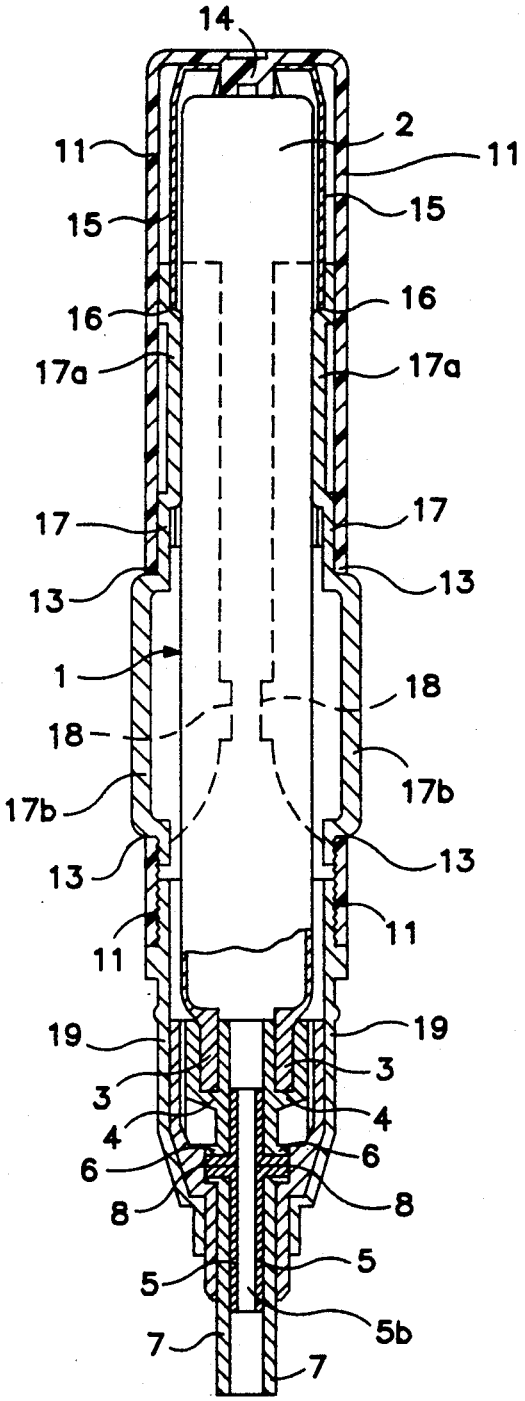
FIG. 4 is a view of the applicator in cross-section, with the cap removed.

Each of these push buttons 17 has, attached to both edges, and curving along the container body's 11 tubular interior surface, an adjoining undercarriage 18; and, as shown in FIG. 4, the push buttons' 17 respective adjoining undercarriages 18 face one another. Thus, if one presses the pressure-sensitive projections 17*b* of each of the push buttons 17 coming out of either side of the container body 11, both sides' push buttons 17 approach one another, resisting the strength of the platform spring 15, and the respective adjoining undercarriages 18 touch one another, making it impossible to press the push buttons 17 any further than this. Also, covering the opening end of the container body 11 is affixed a tapering, tubular point crown 19.

Figure 5:
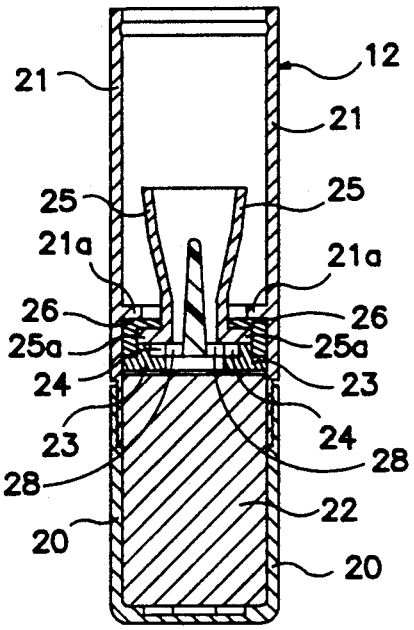
FIG. 5 is a cross-sectional view of the cap of the applicator.

Moreover, the aforementioned cap 12 is freely detachable from and replaceable over the above point crown 19 of the container body 11. This cap 12, as shown in FIGS. 3 and 5, is made by piecing together the end cap 20 and the central cap 21. The end cap 20 is stuffed with filler cotton 22 that has been soaked with solvent. On the surface of one end of this filler cotton 22 are stacked in order: the ring-shaped filler cotton stop 23, the vented stopper arm 24, and the base flange 25*a* of the trumpet-shaped seal packing 25; the cross-cut angular ring-shaped packing guard 26 presses on the outer rim of the above trumpet-shaped seal packing's 25 base flange 25*a*; and, pressing on this ring-shaped packing guard 26, is the interior rim 21*a* of the central cap 21, which protrudes toward its interior. The aforementioned vented stopper arm 24 has thrusting out of its center the columnar stopper 27, around the circumference of which there are permeating apertures 28.

This columnar stopper 27 protrudes into the aforementioned trumpet-shaped seal packing 25; and the open rim of the trumpet-shaped seal packing 25 is made to cover the exterior of the tip of the point crown 19, fitting over it when the cap 12 is closed over the container body 11.

Furthermore, when the container body 11 accomodates the main body 1, as shown in FIG. 1, the tank 2 of the main body 1 goes into the container body 11; and the projections 17*a* of the push buttons 17 at either side of the container body 11 are positioned adjacent to the exterior of the tank 2. Also, one end of the main body's 1 brush point cover 8 is covered by the point crown 19; the brush point cover 8 as well as the brush point 7 go into the above cap's 12 seal packing 25; and inside the seal packing 25 the columnar stopper 27 fits through the hollow center of the brush point and into the brush point pipe's 5 hollow core 5*a*.

In this operational example, when the cap 12 is removed from the container body, as shown in FIG. 4, we have an applicator with a brush point 7 extending from its tip. When one pushes down on the pressure-sensitive projections 17*b* protruding from the windows 13 on either side of the container body 11, the push buttons 17 on either side approach one another, resisting the strength of the platform spring 15; and due to this, each projection 17*a* applies pressure to the tank 2, and the tank 2 is depressed. Because of this, the volatile, highly viscous fluid already placed within the tank 2 passes through the tap 4*a* of the tank 2 mouth's 3 tank cap 4 as well as through the hollow core 5*b* of the brush point pipe 5, and adheres to the hollow inner portion of the brush point 7. Then, when the pressure on the above push buttons 17 is released, by way of the strength of the platform spring 15, the push buttons 17 are returned to their original positions, and the tank 2 also regains its original form.

The application is conducted, then, by holding the container body in the hand and brushing with the brush point 7 onto the item to which the fluid is to be applied. Furthermore, when the applicator is not in use, the above cap 12 covers the container body 11. Thus, as per the above explanation, the brush point 7 as well as the brush point cover's 8 tip end sit within the seal packing 25 closes over the exterior of the point crown 19. Moreover, the columnar stopper 27 within the seal packing 25 passes through the hollow interior of the brush point 7 and dovetails within the hollow core 5*b* of the brush point pipe 5.

Accordingly, due to this columnar stopper 27, the hollow core 5*b* of the brush point pipe 5 is blocked, and the tank 2 is sealed. Further, this seal packing interior 25 serves as the vapor space, since the solvent from the cap's 12 filler cotton 22 vaporizes and fills the interior of the seal packing 25; and, because the brush point 7 is placed within it, the vaporized solvent prevents the brush point 7 from hardening.

Furthermore, this seal packing 25, which passes along the exterior of the brush point 7 and point crown 8, is formed in the shape of a trumpet, and, for this reason, it leaves the solvent's vapor space small and the loss of solvent limited. Also, because of the seal packing's 25 being formed in a trumpet shape, even a bent brush tip 7 is straightened again, as the seal packing acts as a guide for it.

Moreover, in this operational example, because each push button's 17 pressure-sensitive projections 17*b* as well as the tank 2 are made of transparent materials, the color and amount of highly viscous fluid within the tank 2 can be seen through each window 13 of the container body 11.

Also, due to the fact that, as stated above, when the push buttons 17 are pressed, the respective mutually-facing adjoining undercarriages 18 touch one another and prevent the tank 2 from being pressed beyond this point, the amount of highly viscous fluid discharged from the tank 2 by pressing one time is standardized, which is convenient for application. Moreover, if one adjusts the length of the legs of the aforementioned adjoining undercarriages 18, the above highly viscous fluid discharge amount can also be adjusted. And, also, if the highly viscous fluid within the tank 2 should be used up, the main body 1 can be taken out of the container body 11 by removing the point crown 19, and can be exchanged for a new main body 1.

Further, should solvent be used up in the cap's 12 filler cotton 22, the end cap 20 and the central cap 21 can be separated, and the filler cotton 22 can be exchanged for filler cotton 22 which has been sufficiently soaked with solvent.

Figure 6:
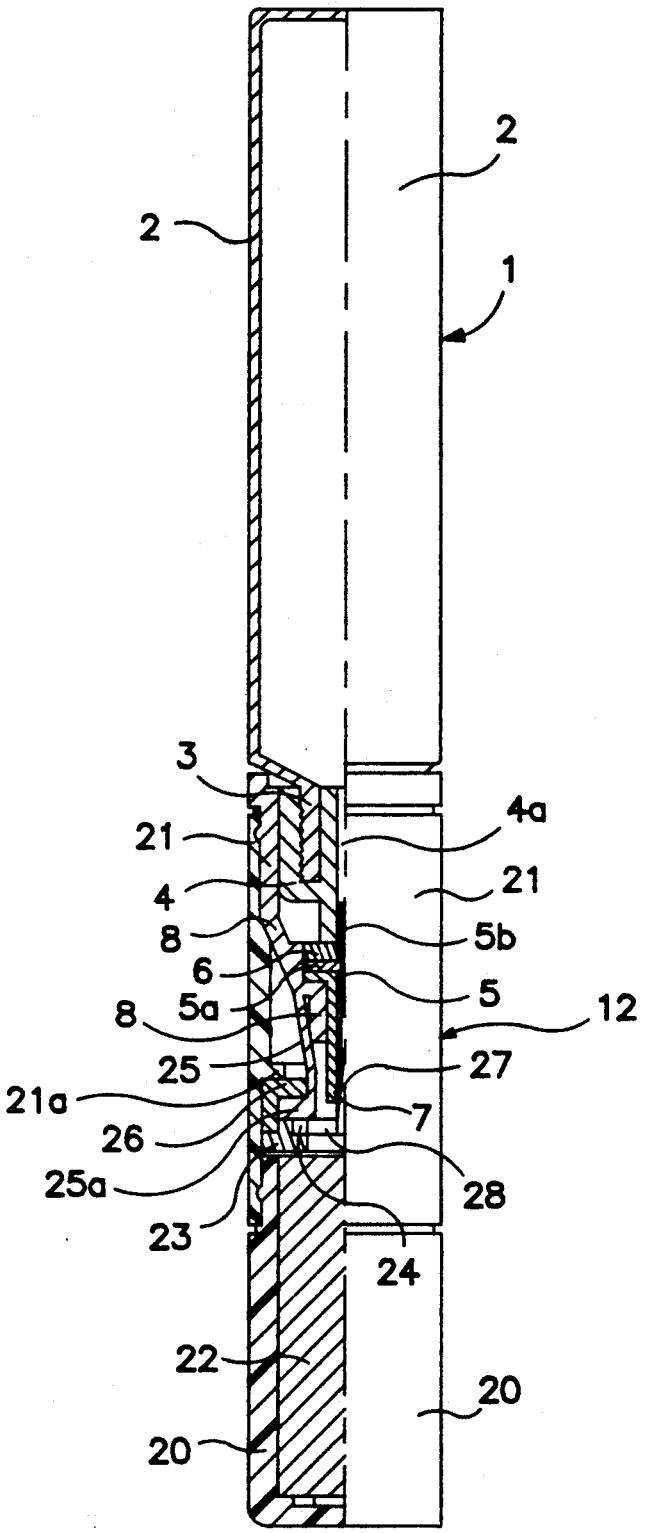
FIG. 6 is a view, partly in cross-section and partly in front elevation, of a modified form of the applicator of the invention.

The above operational example is for an applicator used with the main body 1 placed within the container body 11. But there can also be an example which is so constructed that, as shown in FIG. 6, neither a container body 11 nor a point crown 19 are provided; but, rather, the cap 12 is placed over the main body's 1 brush point cover 8, covering it; and also, the main body's 1 tank 2 is exposed. In this example as well, the application can be done with the cap 12 removed; and when the applicator is not being used the tank is sealed by the columnar stopper 27, and, further, the brush point 7 is usually in contact with the solvent.

Figure 7:
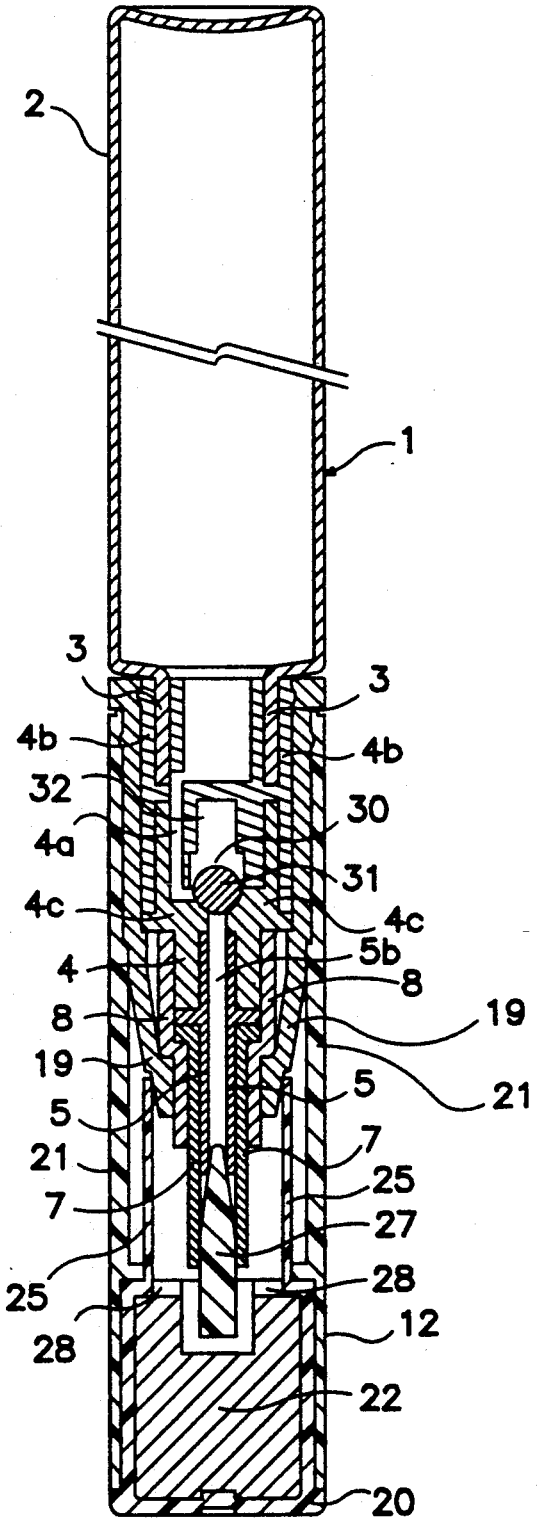
FIG. 7 is a view, partly in cross-section and partly in front elevation, of another modified form of the applicator of the invention.

FIG. 7 shows a further operational example of this device. This operational example has a construction nearly identical to that of the previously described operational example. However, this one has the tank cap 4 divided into two tank cap sections 4*b* and 4*c*, which are united together. This tank cap 4 has a tap 4*a* which passes into the tank 2 in an identical manner to that described in the previous operational example. However, as shown in FIG. 7, this tap 4*a* takes a roundabout, c-shaped route, which is freely closed by a ball 31 which has been inserted into the open-ended hollow space 30 located along the route of the piercing hole. The ball 31 moves within and rubs against this hollow space's 30 rim, and ordinarily it obstructs the above tap 4*a*, as it is submitted to the rebounding power of a spring 32 set within the hollow space 30.

Thus, when the above cap 12 should be removed, although in other cases even with no pressing on the tank 2 the volatile, highly viscous fluid in the tank 2 could leak by flowing out of the brush point pipe's 5 hollow core 5*b* and the brush point 7, nevertheless, in the case of this operational example, the tank cap's 4 tap 4*a* is obstructed by the ball 31, and so the volatile highly viscous fluid does not run unimpeded into the brush point pipe's 5 hollow core 5*b*. So for this example, in order to send the volatile highly viscous fluid to the brush point 7, the tank 2 is pressed with the hand, and he appropriate pressure reaches the tap 4*a*, and pushes the ball 31 into the hollow space 30, resisting the strength of the spring 32. In this manner, the area between the ball 31 and the tap 4*a* opens and the volatile, highly viscous fluid travels through the appropriate passage , passing through the brush point pipe's 5 hollow core 5*b* to reach the brush point 7.

The operational example as currently shown in diagram 7 does not have the tank 2 placed within a container body 11, but, of course, insertion of the tank 2 into a container body 11 can be accomplished.

As for the aforementioned solvent: if the volatile, highly viscous fluid is nail polish, the solvent would be polish remover; it is is correction fluid, the solvent would be thinner; if it is paint, the solvent would be benzine, etc.

With this device, if the cap is placed over the brush point when not in use, the columnar stopper inside the cap passes through the hollow center of the brush point and dovetails into the hollow core of the tank mouth's brush point pipe, sealing the volatile highly viscous fluid into the tank. Thus, the volatile, highly viscous fluid is not exposed to the air, and does not solidify. Furthermore, in the cap there is a vapor space filled with solvent vaporized from the solvent receptacle portion of the cap, and because the brushpoint is place within this vapor space, the brush point is continually exposed to the solvent, and any volatile, highly viscous fluid adhering to the brush point does not harden.

For these reasons, then, this applicator can even be used for volatile fluids of high viscosity, and there is no need for the viscosity to be lowered as in the previous knock style applicators. Moreover, the volatile, highly viscous fluid put into this applicator can be used up completely, not solidifying even to the end, which is efficient.

Preferred embodiments of the applicator of the invention have been described. Those acquainted with the art will understand that various modifications, adaptations and uses of the applicator described can be made without departing from the spirit and scope of the invention.

What is claimed is:

1. An applicator for volatile, highly viscous fluids, comprising: a main body including a pressure-sensitive cylindrical tank for holding a fluid solution, a brush point pipe in a mouth of said tank, a tank cap comprising two interfitted tank cap sections defining a C-shaped tap passage therebetween, a freely rotatable ball mounted in said tank cap and and normally obstructing flow of fluid through said tap passage from said tank to said brush point pipe, and a tubular brush point fitted around an outer circumference of said brush point pipe and extending beyond an end of said brush point pipe; a main body cap covering said brush point, said main body cap enclosing a solvent receptacle stuffed with cotton filler to be soaked with solvent, said main body cap also providing an interior vapor space for solvent vaporized from contents of said solvent receptacle, said main body cap also having a columnar plug for closing an opening at said end of said brush point pipe.

2. The applicator of claim 1 and including a container body mounted about said main body, said container body having cut-out portions and spring mounted push buttons extending through said cut-out portions permitting a user to squeeze sides of said main body for expelling fluid to said brush point from said tank and to control the amount of fluid expelled by pressing said push buttons.

* * * * *